US006841059B1

(12) United States Patent
Staerzl

(10) Patent No.: US 6,841,059 B1
(45) Date of Patent: Jan. 11, 2005

(54) HULL POTENTIAL MONITOR DEVICE HAVING A PLURALITY OF ANNUNCIATORS

(75) Inventor: Richard E. Staerzl, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 405 days.

(21) Appl. No.: 10/132,354

(22) Filed: Apr. 25, 2002

(51) Int. Cl.[7] ..... C23F 13/00

(52) U.S. Cl. ..... 205/727; 205/725; 205/740; 204/196.02; 204/196.06; 204/196.11; 204/196.26; 204/196.37

(58) Field of Search ..... 205/727, 725, 205/726, 740; 204/196.02, 196.06, 196.11, 196.26, 196.37

(56) References Cited

U.S. PATENT DOCUMENTS

| | | | | | |
|---|---|---|---|---|---|
| 4,117,345 | A | * | 9/1978 | Balcom | 307/95 |
| 4,322,633 | A | * | 3/1982 | Staerzl | 204/196.02 |
| 4,492,877 | A | | 1/1985 | Staerzl | 307/95 |
| 4,528,460 | A | * | 7/1985 | Staerzl | 204/196.03 |
| 4,894,135 | A | * | 1/1990 | Farque | 204/196.03 |
| 5,102,514 | A | * | 4/1992 | McCready | 205/729 |
| 5,139,634 | A | * | 8/1992 | Carpenter et al. | 205/727 |
| 5,373,728 | A | | 12/1994 | Guentzler | 73/40 |
| 5,452,443 | A | * | 9/1995 | Oyamada et al. | 714/10 |
| 5,627,414 | A | | 5/1997 | Brown et al. | 307/95 |
| 5,747,892 | A | * | 5/1998 | Staerzl | 307/95 |
| 6,173,669 | B1 | * | 1/2001 | Staerzl | 114/222 |
| 6,183,625 | B1 | * | 2/2001 | Staerzl | 205/727 |
| 6,209,472 | B1 | * | 4/2001 | Staerzl | 114/222 |
| 6,559,660 | B1 | * | 5/2003 | Staerzl | 324/712 |
| RE38,581 | E | * | 9/2004 | Doniguian | 205/724 |

OTHER PUBLICATIONS

Seaguard Ltd, Internet Data.
LM3914 Dot/Bar Display Driver, National Semiconductor, pp. 4–25 to 4–29.

* cited by examiner

*Primary Examiner*—Bruce F. Bell
(74) *Attorney, Agent, or Firm*—William D. Lanyi

(57) ABSTRACT

A monitor for use in conjunction with a galvanic protection system for a marine vessel provides automatic and continuous monitoring of a voltage at a reference electrode of the galvanic protection system and displays the results continuously by energizing one or more of a plurality of annunciators, such as light emitting diodes. The light emitting diodes are energized in groups of one or two in order to double the effective resolution of a group of ten annunciators. The selected annunciators are energized intermittently in order to conserve electrical power while continuously and automatically running. The frequency of activation of the selected annunciators is changed whenever the voltage potential being monitored falls within a minimum range or a maximum range in order to alert the operator of a potentially catastrophe result. A lower frequency is used when the monitor voltage is not within these minimum and maximum ranges.

21 Claims, 3 Drawing Sheets

HULL POTENTIAL MONITOR DEVICE HAVING A PLURALITY OF ANNUNCIATORS

BACKGROUND OF THE INVENTION

1. Field of the Invention

The present invention is generally related to hull potential monitors and, more particularly, to a hull potential monitor that operates continuously without the need for operator intervention and conserves energy by intermittently pulsing, or energizing, one or more of the annunciators to represent a magnitude of hull potential or, alternatively stated, a degree of hull protection from corrosion.

2. Description of the Prior Art

Various types of galvanic protection devices for use with marine vessels are known to those skilled in the art. In order to make sure that the cathodic protection device is operating properly to inhibit corrosion of various parts of a marine vessel, it is helpful to know the actual voltage potential in the region of those protected components.

U.S. Pat. No. 4,492,877, which issued to Staerzl on Jan. 8, 1985, discloses an electrode apparatus for cathodic protection. The apparatus is provided for mounting an anode and reference electrode of a cathodic protection system on an outboard drive unit. The apparatus includes an insulating housing on which the anode and reference electrode are mounted and a copper shield mounted between the anode and electrode to allow them to be mounted in close proximity to each other. The shield is electrically connected to the device to be protected and serves to match the electrical field potential at the reference electrode to that of a point on the outboard drive unit remote from the housing.

U.S. Pat. No. 6,183,625, which issued to Staerzl on Feb. 6, 2001, discloses a marine galvanic protection monitor. The monitor system uses two annunciators, such as light emitting diodes, to alert a boat operator of the current status of the boat's galvanic protection system. A reference electrode is used to monitor the voltage potential at a location in the water and near the component to be protected. The voltage potential of the electrode is compared to upper and lower limits in order to determine if the actual sensed voltage potential is above the lower limit and below the upper limit. The two annunciator lights are used to inform the operator if the protection is proper or if the component to be protected is either being over protected or under protected.

U.S. Pat. No. 5,627,414, which issued to Brown et al on May 6, 1997, describes an automatic marine cathodic protection system using galvanic anodes. An automatic system uses sacrificial galvanic anodes to provide a controlled and optimum amount of cathodic protection against galvanic corrosion on submerged metal parts. Intermittently pulsed control circuitry enables an electromechanical servo system to control a resistive element interposed between the sacrificial anodes and the electrically bonded underwater parts. In an active mode of operation a current is applied directly to the anodes to quickly establish the proper level of correction which is maintained during the passive mode. Incremental corrections are made over a period of time to provide stabilization of the protection and to conserve power. A visual indication of the amount of protection is available at all times. Circuitry and indicating devices are included which facilitate location and correction of potentially harmful stray currents and to prevent loss of sacrificial anodes to nearby marine structures.

U.S. Pat. No. 5,373,728, which issued to Guentzler on Dec. 20, 1994, describes a galvanic anode device and electrolysis control monitor. The use of a sacrificial anode in a plumbing system or in the cooling system of an internal combustion engine or the like to protect the system against the destructive effects of electrolysis caused by the many different metals employed in modern plumbing systems or engines is disclosed, along with several methods and apparatus for monitoring the condition of the sacrificial anode to indicate when replacement is needed for continued protection of the system. Physical, optical and electrical systems are taught, each designed to indicate the need for replacement of the anode in an easily discernable manner.

A hull protection monitor is commercially available from Seaguard Ltd which is located Christchurch, New Zealand. Seaguard Ltd provides a corrosion monitor which is identified by the name "Sentry" which requires the operator to press a test button to activate the monitor. The monitor activates a light emitting diode to represent the condition of the corrosion protection system of a marine vessel. The light emitting diode is automatically de-energized after one minute in order to conserve battery life. This device comprises six annunciators which allow is the monitor to inform the operator relative to two degrees of overprotection, two degrees of underprotection, and two degrees of proper protection. The light emitting diodes are activated one at a time in response to the marine vessel operator pressing the test button.

The patents described above are hereby expressly incorporated by reference in the description of the present invention.

Cathodic protection systems for use with marine vessels are both helpful and necessary, particularly when the vessel is operated in saltwater conditions. Although most known galvanic protection systems continually monitor their own operation, they don't typically inform the marine vessel operator of their current condition unless some type of fault condition occurs. Also, some known cathodic protection monitoring devices require manual intervention by the marine vessel operator in order to activate them. It is easy to imagine a cathodic protection system that is gradually becoming inoperable, but is not yet malfunctioning to the extent that an alarm condition exists. It is also easy to imagine a cathodic protection system that is ignored by the marine vessel operator for extended periods of time, through oversight or carelessness, while the protection system continually degrades from an operable condition toward an inoperable condition. The marine vessel operator, under these situations, would not typically know that failure of the cathodic protection system is imminent and that replacement of components or repair of the system would be immediately advisable, prior to the cathodic protection system becoming completely inoperable.

It would therefore be significantly beneficial if an automatic and continuously running monitor could be provided which alerts the marine vessel operator of the precise condition of the cathodic protection system even when the system is operating perfectly. It would also be beneficial if a monitor of this type could continuously inform the operator if the cathodic protection system gradually begins to change from a perfectly operable system toward a less desirable status and gradually toward an inoperable condition. Furthermore, it would be beneficial if a monitor of this type could be operated in a way that conserves power during its automatic and continuous operation.

SUMMARY OF THE INVENTION

A hull potential monitor, made in accordance with the preferred embodiment of the present invention, comprises a first circuit point, which is connectable to a component to be monitored, and a plurality of annunciators, wherein each of the plurality of annunciators is representative of a predefined magnitude, or magnitude range, of a voltage potential of the first circuit point. An annunciator selector has an input connected to the first circuit point and has an output connected in signal communication with the plurality of annunciators which determines which one or more of the plurality of annunciators are energized in response to the voltage potential of the first circuit point. In also comprises a frequency selector connected in signal communication with the annunciator selector for determining an activation rate at which the one or more of the plurality of annunciators are intermittently energized in response to the voltage potential of the first circuit point.

The frequency of the activation rate, when the voltage potential of the first circuit point is within a predefined maximum range, is greater than the frequency of the activation rate when the voltage potential of the first circuit point is not within a predefined maximum range. The same is true for a predefined minimum range. The component to be monitored is preferably a reference electrode of a marine galvanic protection circuit. Each of the plurality of annunciators is representative of a predefined magnitude, or predefined magnitude range, of a voltage potential of the first circuit point. The annunciator selector is configured to energize a single one of the plurality of annunciators or two of the plurality of annunciators which are associated with either the voltage potential of a first circuit point that is within the magnitude range associated with the annunciator or, alternatively, two annunciators that are associated with numerically adjacent magnitude ranges of the voltage potential of the first circuit point in response to the voltage potential of the first circuit point being numerically between the numerically adjacent magnitude ranges of the voltage potential of the first circuit point. In a typical application of the present invention, the plurality of annunciators comprises ten annunciators which are light emitting diodes. The annunciator selector is continuously active and independent of operator intervention.

The method of the present invention in a preferred embodiment, comprises the steps of providing a first circuit point which is connectable in electrical communication with a component to be monitored, providing a plurality of annunciators, wherein each of the annunciators is representative of a predefined magnitude of a voltage potential of the first circuit point, and selecting one or more representative annunciators of the plurality of annunciators as a function of the voltage potential of the first circuit point. It further comprises the step of intermittently energizing the one or more representative annunciators at a preselected activation rate. The preselected activation rate is higher when the voltage potential of the first circuit point is within a predefined maximum range or a predefined minimum range. The selecting step selects either a single one of the annunciators or two of the annunciators, as a function of the voltage magnitude. This provides increased resolution that is generally twice that which would be available if the annunciators are energized one at a time.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
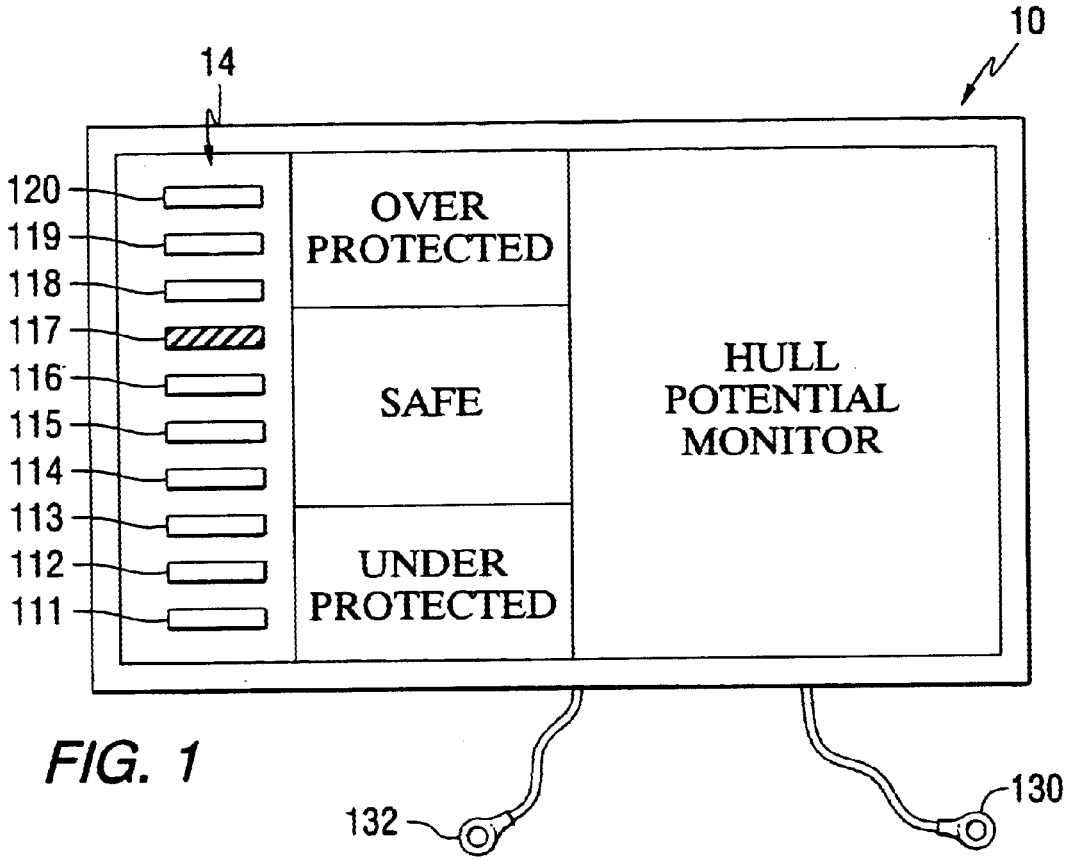
FIG. 1 shows the monitor of the present invention.

Throughout the description of the preferred embodiment of the present invention, like components will be identified by like reference numerals.

FIG. 1 shows the hull potential monitor 10 of the present invention. Its primary intent is to inform the operator of a marine vessel about the operating condition of the cathodic protection system on that marine vessel. It is also intended to continuously operate without any required manual intervention and to continually inform the operator of the precise status, or degree of protection, provided to the marine vessel by the cathodic protection system of that vessel. On the left side of the monitor 10, a plurality of annunciators 14 are arranged in order of associated degrees of protection. For example, annunciators 111–113 each represent a different degree of underprotection being provided by the cathodic protection system while annunciators 118–120 each represent different degrees of overprotection. Annunciators 114–117 represent various degrees of appropriate protection being provided by the galvanic protection system.

With continued reference to FIG. 1, it can be seen that annunciator 117 is cross-hatched. This representation signifies that annunciator 117 is energized. In a particularly preferred embodiment of the present invention, each of the annunciators, 111–120, is a light emitted diode (LED) contained in a component identified as the "LM 3914 Dot/Bar Display Driver" which is available in commercial quantities from the National Semiconductor Company. This commercially available device allows an associated circuit to energize the light emitting diodes in groups of 1 to 10 at a time.

With continued reference to FIG. 1, the hull potential monitor 10 is provided with two connections, 130 and 132, that allow the hull potential monitor 10 to be connected in electrical communication with a reference electrode and a point of ground potential such as the hull of the marine vessel, respectively. For example, in a cathodic protection system such as that described in U.S. Pat. No. 6,183,625, discussed above, electrical lead 130 would be connected to the reference electrode identified by reference number 44 in that United States patent. Electrical connector 132 would be connected to a point of ground potential, such as the line identified by reference numeral 56 in U.S. Pat. No. 6,183,625.

If the individual annunciators, 111–120, are energized one at a time, the plurality of annunciators 14 shown in FIG. 1 would allow a resolution of 10 steps between the lowest degree of protection represented by annunciator 111 and the highest degree of overprotection represented by annunciator 120. In order to increase the resolution of the monitor 10, the present invention energizes either one or two annunciators at a time in order to represent nineteen different resolution steps between the minimum and maximum voltages sensed at the reference electrode.

Figure 2:
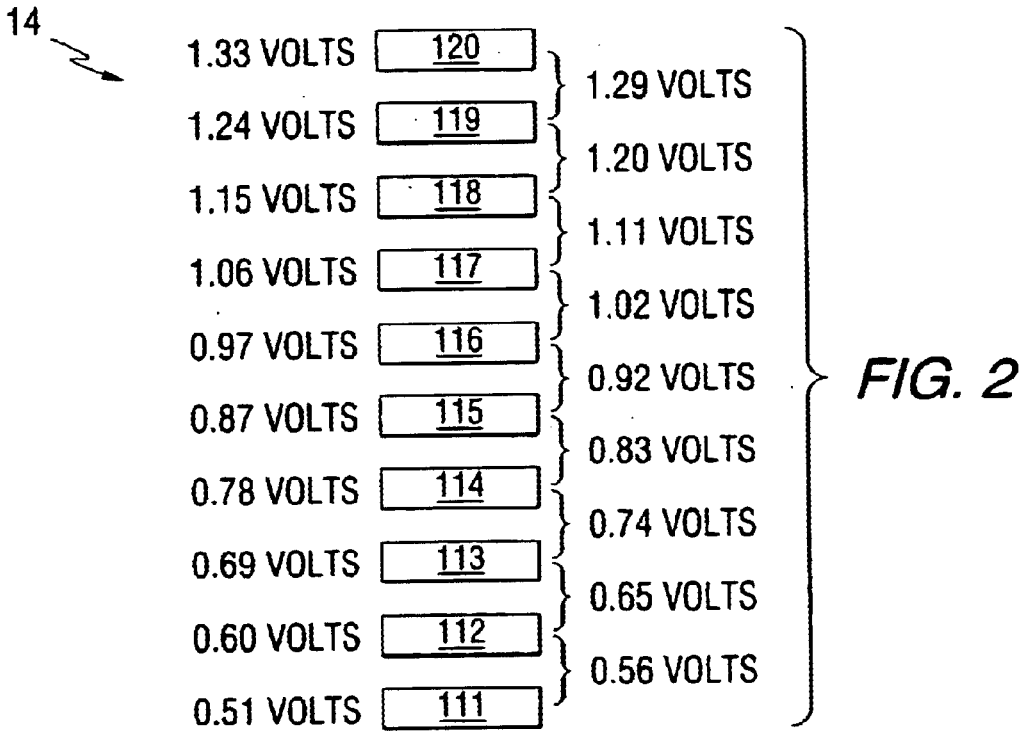
FIG. 2 is a numeric representation showing the corresponding voltage magnitudes associated with each individual or pair of annunciators.

FIG. 2 represents the plurality of annunciators 14 along with the particular numerical voltage potential represented by their energization, either individually or in combination with an adjacent annunciator. For example, the numeric references to the left of the plurality of annunciators 14 in FIG. 2 represent the particular voltages at which each of the annunciators is energized individually. As an example, annunciator 114 would be energized, with no other annunciators being energized, if the voltage potential at the reference electrode is generally equal to 0.78 volts. Similarly, annunciator 118 would be energized if the reference electrode voltage was generally equal to. 1.15 volts. The numeric references to the right of the plurality of annunciators 14 represent the voltage at which an adjacent pair of annunciators would be energized by the present invention. As an example, if the reference electrode potential is generally equal to 1.11 volts, annunciators 117 and 118 would be energized in combination with each other to alert the operator of this particular voltage potential. Since the individual annunciators, 111–120, can be energized either individually or in combination with an adjacent annunciator, the resolution provided by the plurality of annunciators 14 is twice that which would otherwise be possible. The procedure of the present invention allows nineteen individual steps to be annunciated to the operator of the marine vessel through the use of the 10 annunciators shown in FIGS. 1 and 2.

Figure 3:
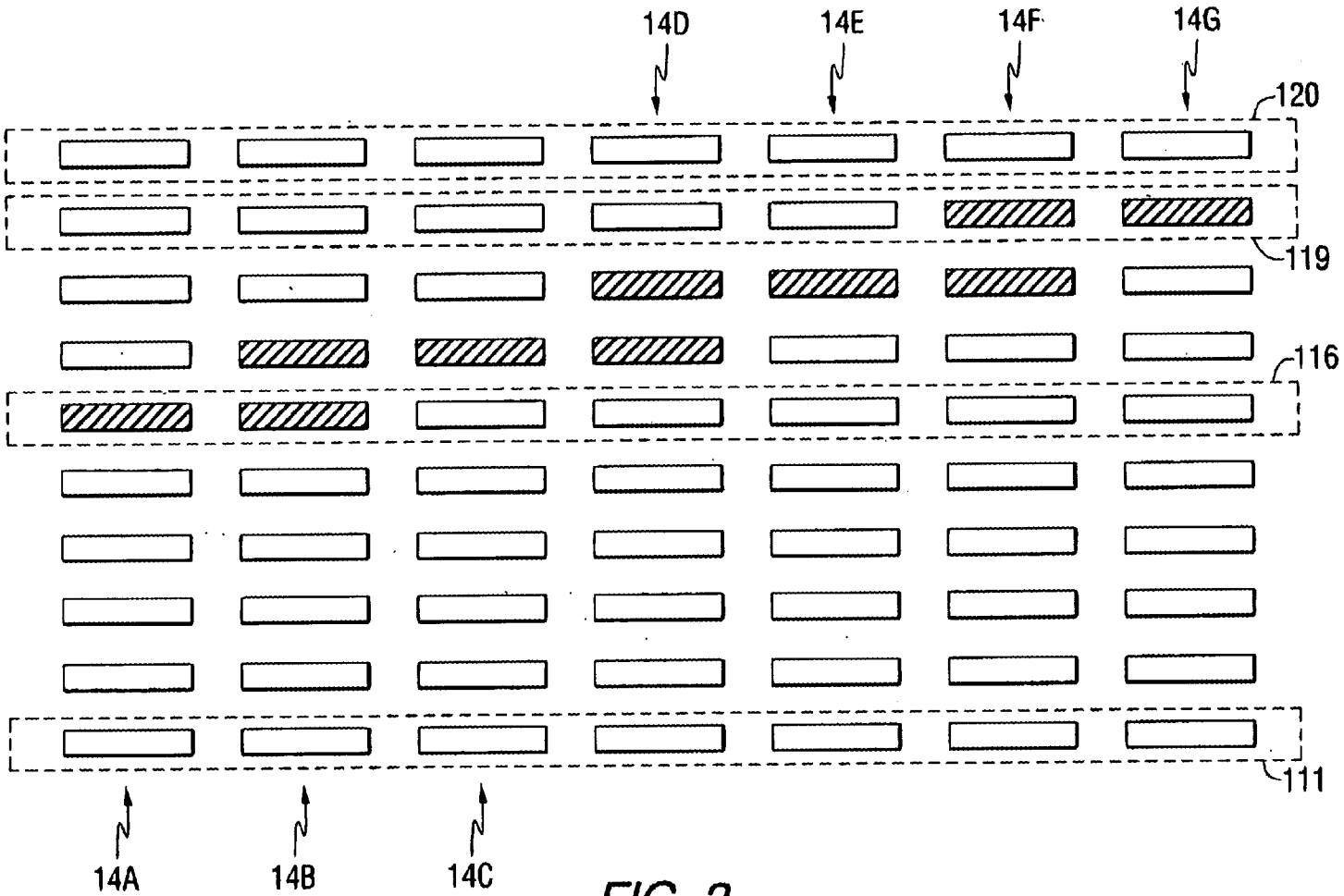
FIG. 3 is a chronological representation of various conditions provided to show how the present invention reacts to those changing conditions.

FIG. 3 represents the plurality of annunciators 14 under seven distinct condition states that could occur chronologically as the hull potential, measured at the reference electrode, proceeds from approximately 0.97 volts as represented by annunciator 116 in condition 14A of FIG. 3 to 1.24 volts represented by annunciator 119 at condition 14G. It can be seen that, as the reference electrode potential gradually increases from the condition shown at 14A to the condition shown at 14G, six unique representations, or steps, are provided chronologically to the operator of the marine vessel. At the time when condition 14B is shown to the operator, the hull potential measured at the referenced electrode is approximately 1.02 volts. This reference electrode voltage increases, over time, and is tracked for the operator of the marine vessel by the sequential steps (i.e. configurations) shown in FIG. 3. For purposes of reference, FIG. 3 is provided with four dashed line boxes to illustrate the lowest potential annunciator 111, a midrange annunciator. 116 and two upper range annunciators, 119 and 120.

Figure 4:
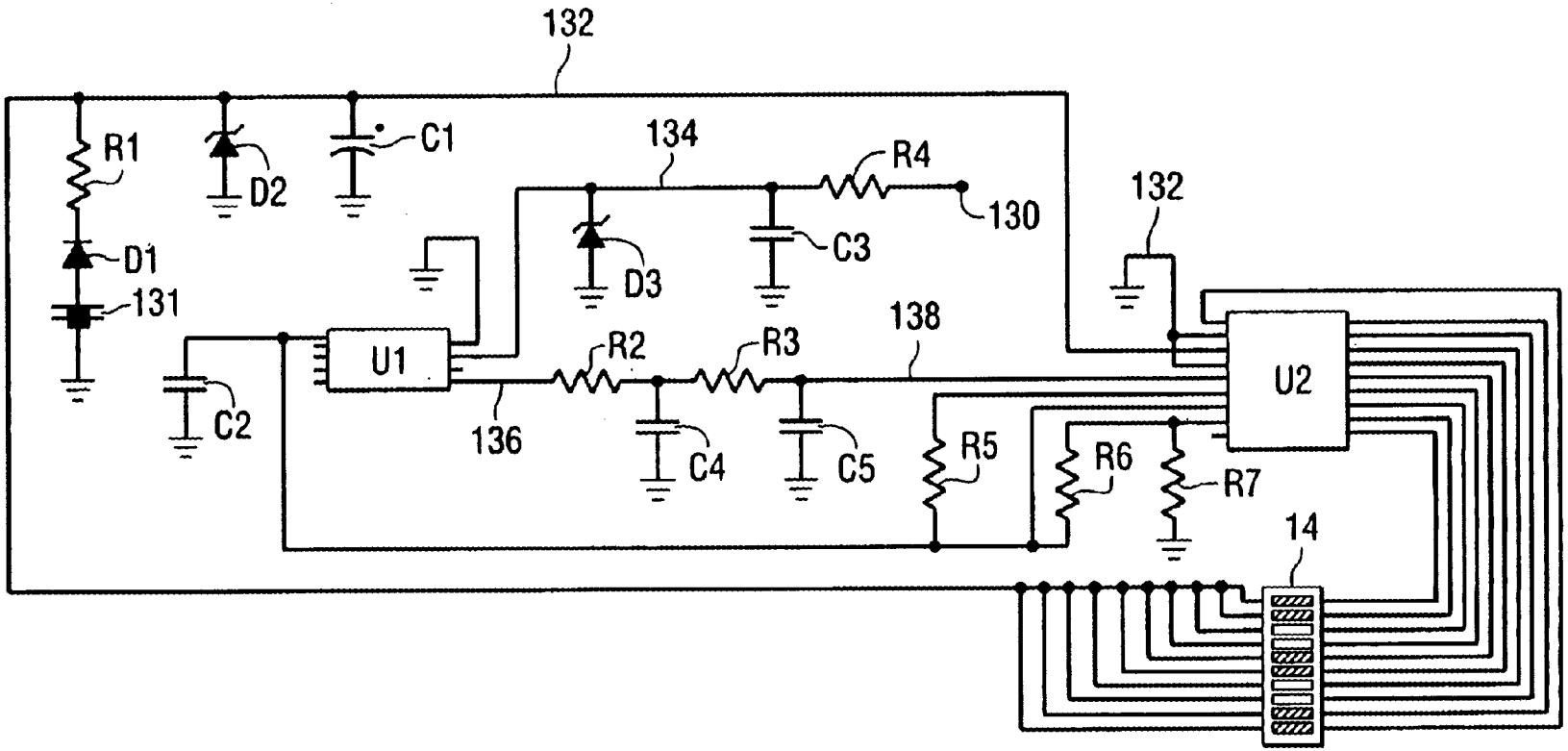
FIG. 4 is the electrical circuit of the present invention.

FIG. 4 shows the electrical circuit used to perform the functions of the present invention. The components are identified in Table I. Resistor R1 is a positive temperature coefficient (PTC) resistive device that operates as a resettable fuse to protect the circuit shown in FIG. 4. Diode D1 protects the circuit in case the battery 131 is improperly connected to the circuit.

TABLE I

| REFERENCE NUMERAL | MAGNITUDE OR TYPE |
|---|---|
| R1 | PTC 25 Ω |
| R2 | 10 kΩ |
| R3 | 10 kΩ |
| R4 | 10 kΩ |
| R5 | 1 kΩ |
| R6 | 1 kΩ |
| R7 | 2.87 kΩ |
| C1 | 10 μF |
| C2 | 0.01 μF |
| C3 | 0.01 μF |
| C4 | 0.01 μF |
| C5 | 0.01 μF |
| D1 | 1 AMP |
| D2 | SA15A |
| D3 | 1N5231 |
| 14 | MV5B164 |
| U1 | PIC12C672 |
| U2 | LM3914 |

Diode D2, which is a zenor diode, is used to suppress transient voltages that may occur in the connection between resistor R1 and capacitor C1. Capacitor C1 is intended to filter any minor variations in the signal on line 132. Circuit point 130 in FIG. 4 is connectable to the reference electrode and associated conductor, as identified by reference numerals 44 and 58 in U.S. Pat. No. 6,183,625 which is described above. Resistor R4 in FIG. 4 is intended as a current limiting resistor in order to protect the circuit from high voltage magnitudes that could result from an improper connection of the circuit to the corrosion protection system of a marine vessel. Capacitor C3 is a noise filter and zenor diode D3 is intended to limit the voltage potential on line 134. Component U1 is a microprocessor that contains the logic used to perform the functions of the present invention.

One of the functions performed by the microprocessor U1 is to convert the magnitude of the voltage on line 134 to a corresponding voltage on line 136. In a particularly preferred embodiment of the present invention, the voltage on line 134 is between 1 and 2 volts while the output voltage on line 136 is between 0 and 5 volts. Microprocessor U1 makes the mathematical conversion between the input signal on line 134 to the output signal on line 136. This is a simple linear conversion in order to suit the required input voltages of the light emitting diode driver U2. Lookup tables are used to perform this conversion.

Resistors R2 and R3 and capacitors C4 and C5 are used to provide an R—C network that filters the output signal on line 136. This filtering network provides a generally smooth input signal on line 138 to pin 5 of the LED driver U2. The magnitude of the voltage signal on line 138 determines which one or more annunciators of the plurality of annunciators 14 is energized at any given time.

Resistors R5, R6, and R7 are chosen to satisfy certain specified requirements of the LED driver U2. These resistors are connected to pins 7, 8, and 9, respectively, of the LED driver in order to appropriately set the required voltage to energize the highest LED, a reference adjustment voltage, and the lowest LED, respectively.

By using a look-up table, the microprocessor U1 converts the 1–2 volt signal received on line 134 to an output signal on line 136 which is generally 0 to 5 volts. It should be clearly understood that the input voltage from the reference electrode, received at circuit point 130, is typically not expected to exceed approximately 1.33 volts and the output voltage on line 130 adjusts for this expectation. In addition, in order to avoid a situation in which no LED is energized in the plurality of annunciators 14, the output signal on line 136 is adjusted to achieve a minimum value of 0.51 volts in order to assure that at least one annunciator is energized. By appropriately selecting the voltage magnitude on line 138, the present invention selects one or two of the plurality of annunciators 14 in order to signify the precise voltage at the reference electrode of a galvanic protection system.

With continued reference to FIG. 4, the microprocessor U1 also provides a high frequency burst of pulses on line 136. The length of the burst has a 10% duty cycle on line 136. With a duty cycle of individual pulses within each burst being 50% the filtering network that comprises resistors R2 and R3 and capacitors C4 and C5 causes a resulting signal of approximately 50% voltage magnitude, or approximately 2.5 volts full scale on line 138. The bursts provided by the microprocessor U1 at its output 136 are provided at a frequency of approximately 200 Hertz. This output lasts for approximately 0.1 seconds and is turned off for approximately 0.9 seconds. This results in an intermittent energization of the energized light emitting diodes of the plurality of light emitting diodes 14 at a frequency of approximately 1.0 Hertz. If either the minimum annunciator 111 or the maximum annunciator 120 is energized, the frequency of energization is doubled to 2.0 Hertz in order to more emphatically alert the operator of this extreme disadvantageous condition. If the other annunciators, 112–119, are energized, they are intermittently pulsed at the lower frequency of 1.0 Hertz. Again, it should be understood that all of the annunciators, 111–120 can be energized either individually or in combination with an adjacent annunciator in order to signify a hull potential that is represented numerically on the right side of FIG. 2.

The microprocessor U1 performs several simple functions as described above. First, it uses a look-up table to convert the input voltage on line 134 to an associated output voltage on line 136. In one embodiment of the present invention, this comprises the effective multiplication of the input voltage by approximately 2.5 to convert from the 0–2 volt range at circuit point 130 to the 0–5 volt expected by the LED driver U2. However, as described above, this conversion is also manipulated in order to satisfy certain required input characteristics of the signal on line 138 to the LED driver. These adjustments are made in order to satisfy the requirements of the particular component used as the plurality of annunciators 14 in a particularly preferred embodiment of the present invention and are not limiting to the present invention. The microprocessor U1 also determines the activation rate at which the signal on line 136 will be intermittently provided. Two different activation rates are used in a preferred embodiment of the present invention, with the normal activation rate being 1.0 Hertz and a double activation rate of 2.0 Hertz being used when either the minimum annunciator 111 or the maximum annunciator 120 is energized.

With reference to FIGS. 1–4, it can be seen that a hull potential monitor made in accordance with the preferred embodiment of the present invention comprises a first circuit point 130 which is connectable to a component to be monitored, such as a reference electrode of a galvanic protection system for a marine vessel. It also comprises a plurality of annunciators 14, wherein each of the annunciators is representative of a predefined magnitude range of a voltage potential of the first circuit point 130. Naturally, each of the numeric voltage magnitudes illustrated in FIG. 2 is represented by a reasonable range of magnitudes around each of the designated voltage potentials. In this way, a gradual increase or decrease in hull potential will be represented by a gradual, change in the energized annunciators, as illustrated and described in conjunction with FIG. 3. An annunciator selector, which comprises microprocessor U1 and the filtering network comprising resistors R2 and R3 and capacitors C4 and C5 has an input 134 that is connected to the first circuit point 130 and has an output 136 connected in signal communication with the plurality of annunciators 14. The annunciator selector determines which one or more of the plurality of annunciators 14 are energized in response to the voltage potential at the first circuit point 130. The present invention also comprises a frequency selector whose function is performed by microprocessor U1 which is connected in signal communication with the annunciator selector for determining an activation rate at which the one or more of the plurality of annunciators 14 are intermittently energized in response to the voltage potential of the first circuit point 130. It should be understood that the annunciator selector and the frequency selector are functions performed by the microprocessor which comprise simple look-up tables which convert the voltage potential at the first circuit point 130 to a suitable voltage required by the LED driver U2 and the plurality of annunciators 14. The frequency, in one embodiment, is simply doubled when the minimum 111 or maximum 120 annunciators are energized in order to alert the operator of this condition. The intermittent energization of the annunciators is provided to conserve energy since the present invention operates continuously without any required intervention on the part of the operator of the marine vessel. In other words, the operator of the marine vessel does not have to push any buttons in order to cause the present invention to provide an output signal that is representative of the condition of the boat's galvanic protection system As described above, the component to be monitored is normally a reference electrode of a marine galvanic protection circuit. The annunciator selector is configured to energize a single one of the plurality of annunciators 14 when the voltage potential of the first circuit point is within a magnitude range associated with that particular single one of the plurality of annunciators. It is also configured to energize two of the plurality of annunciators 14 which are associated with numerically adjacent magnitude ranges of the voltage potential at the first circuit point 130 in response to the voltage potential of the first circuit point 130 being numerically between the numerically adjacent magnitude ranges of the voltage potential at the first circuit point 130. In other words, the numeric magnitude ranges illustrated in FIG. 2 determine whether one or two annunciators are energized at any particular time. As described above, the plurality of annunciators 14 in a preferred embodiment of the present invention comprise ten annunciators, 111–120. Each of the plurality of annunciators, in a preferred embodiment, is a light emitting diode. It is important to note that the annunciator selector of the present invention is continuously active and independent of operator intervention.

The method for monitoring a hull potential of a marine vessel, made in accordance with the present invention, comprises the steps of providing a first circuit point 130 which is connectable in electrical communication with the component to be monitored, such as a reference electrode of a galvanic protection circuit. It further comprises the step of providing a plurality of annunciators 14, wherein each of the plurality of annunciators is representative of a predefined magnitude, or magnitude range, of a voltage potential of the first circuit point 130. It further comprises the step of selecting one or more representative annunciators of the plurality of annunciators 14 as a function of the voltage potential of the first circuit point 130 and intermittently energizing the one or more representative annunciators at a preselected activation rate. The preselected activation rate, which can be 1.0 Hertz or 2.0 Hertz in a preferred embodiment, is selected as a function of the voltage potential of the first circuit point 130 as described above. The preselected preactivation rate is higher when the voltage potential of the first its circuit point is within a predefined maximum range or a predefined minimum range, such as those associated with annunciators 120 and 111, respectively. The selecting step of the present invention selects a single one of the plurality of annunciators 14 when the voltage potential of the first circuit point 130 is within a magnitude range associated with a single one of the plurality of annunciators and selects two of the plurality of annunciators which are associated with numerically adjacent magnitude ranges of the voltage potential of the first circuit point 130 in response to the voltage potential of the first circuit point being numerically between the numerically adjacent magnitude ranges of the voltage potential at the first circuit point.

Although the present invention has been described in particular specificity and illustrated to show particularly preferred embodiment, it should be understood that alternative embodiments are also within its scope.

I claim:

1. A hull potential monitor, comprising:

a first circuit point which is connectable to a component to be monitored;

a plurality of annunciators, wherein each of said plurality of annunciators is representative of a predefined magnitude of a voltage potential of said first circuit point;

an annunciator selector having an input connected to said first circuit point and having an output connected in signal communication with said plurality of annunciators which determines which one or more of said plurality of annunciators are energized in response to said voltage potential of said first circuit point; and a frequency selector connected in signal communication with said annunciator selector for determining an activation rate at which said one or more of said plurality of annunciators are intermittently energized in response to said voltage potential of said first circuit point.

2. The hull potential monitor of claim 1, wherein:

said frequency selector is configured to cause the frequency of said activation rate when said voltage potential of said first circuit point is within a predefined maximum range to be greater than the frequency of said activation rate when said voltage potential of said first circuit point is not within a predefined maximum range.

3. The hull potential monitor of claim 2, wherein:

said frequency selector is configured to cause the frequency of said activation rate when said voltage potential of said first circuit point is within a predefined minimum range to be greater than the frequency of said activation rate when said voltage potential of said first circuit point is not within a predefined minimum range.

4. The hull potential monitor of claim 1, wherein:

said component to be monitored is a reference electrode of a marine galvanic protection circuit.

5. The hull potential monitor of claim 1, wherein:

each of said plurality of annunciators is representative of a predefined magnitude range of a voltage potential of said first circuit point.

6. The hull potential monitor of claim 1, wherein:

said annunciator selector is configured to energize a single one of said plurality of annunciators when said voltage potential of said first circuit point is it within a magnitude range associated with said single one of said plurality of annunciators.

7. The hull potential monitor of claim 1, wherein:

said annunciator selector is configured to energize two of said plurality of annunciators which are associated with numerically adjacent magnitude ranges of said voltage potential of said first circuit point in response to said voltage potential of said first circuit point being numerically between said numerically adjacent magnitude ranges of said voltage potential of said first circuit point.

8. The hull potential monitor of claim 1, wherein:

said plurality of annunciators comprise ten annunciators.

9. The hull potential monitor of claim 1, wherein:

each of said plurality of annunciators is a light emitting diode.

10. The hull potential monitor of claim 1, wherein:

said annunciator selector is continuously active and independent of operator intervention.

11. A method for monitoring a hull potential of a marine vessel, comprising the steps, of:

providing a first circuit point which is connectable in electrical communication with a component to be monitored;

providing a plurality of annunciators, wherein each of said plurality of annunciators is representative of a predefined magnitude of a voltage potential of said first circuit point;

selecting one or more representative annunciators of said plurality of annunciators as a function of said voltage potential of said first circuit point and intermittently energizing said one or more representative annunciators at a preselected activation rate.

12. The method of claim 11, further comprising:

selecting said preselected activation rate as a function of said voltage potential of said first circuit point.

13. The method of claim 12, wherein:

said preselected activation rate is higher when said voltage potential of said first circuit point is within a predefined maximum range.

14. The method of claim 12, wherein:

said preselected activation rate is higher when said voltage potential of said first circuit point is within a predefined minimum range.

15. The method of claim 12, wherein:

said selecting step selects a single one of said plurality of annunciators when said voltage potential of said first circuit point is within a magnitude range associated with said single one of said plurality of annunciators.

16. The method of claim 12, wherein:

said selecting step selects two of said plurality of annunciators which are associated with numerically adjacent magnitude ranges of said voltage potential of said first circuit point in response to said voltage potential of said first circuit point being numerically between said numerically adjacent magnitude ranges of said voltage potential of said first circuit point.

17. The method of claim 12, wherein:

said plurality of annunciators comprise ten annunciators.

18. The method of claim 12, wherein:

each of said plurality of annunciators is a light emitting diode.

19. A hull potential monitor, comprising:

a first circuit point which is connectable in electrical communication with a component to be monitored;

a plurality of annunciators, wherein each of said plurality of annunciators is representative of a predefined magnitude of a voltage potential of said first circuit point;

means for selecting one or more representative annunciators of said plurality of annunciators as a function of said voltage potential of said first circuit point; and means for intermittently energizing said one or more representative annunciators at a preselected activation rate.

20. The monitor of claim 19, further comprising:

means for selecting said preselected activation rate as a function of said voltage potential of said first circuit point.

21. The monitor of claim 20, wherein:

said means for selecting is configured to select a single one of said plurality of annunciators when said voltage potential of said first circuit point is within a magnitude range associated with said single one of said plurality of annunciators; and said means for selecting is configured to select two of said plurality of annunciators which are associated with numerically adjacent magnitude ranges of said voltage potential of said first circuit point in response to said voltage potential of said first circuit point being numerically between said numerically adjacent magnitude ranges of said voltage potential of said first circuit point.

* * * * *